United States Patent [19]

Ateya et al.

[11] Patent Number: 4,496,644

[45] Date of Patent: Jan. 29, 1985

[54] ELECTRIC FIELD ADJUSTMENT FOR MAGNETIC BRUSHES

[75] Inventors: Antoun I. Ateya; Wei C. Lu, both of Rochester, N.Y.

[73] Assignee: Eastman Kodak Company, Rochester, N.Y.

[21] Appl. No.: 470,124

[22] Filed: Feb. 28, 1983

[51] Int. Cl.[3] ..... G03G 13/09; G03G 15/09

[52] U.S. Cl. ..... 430/122; 118/657; 118/658; 355/3 DD

[58] Field of Search ..... 430/122; 118/657, 658

[56] References Cited

U.S. PATENT DOCUMENTS

| | | | |
|---|---|---|---|
| 2,073,057 | 3/1937 | Goedrich . | |
| 3,328,193 | 6/1967 | Oliphant et al. . | |
| 3,543,720 | 12/1970 | Drexler et al. . | |
| 3,639,245 | 2/1972 | Nelson . | |
| 3,654,893 | 4/1972 | Piper et al. . | |
| 3,805,739 | 4/1974 | Feldeisen et al. . | |
| 3,816,840 | 6/1974 | Kotz . | |
| 3,893,935 | 7/1975 | Jadwin et al. . | |
| 3,911,864 | 10/1975 | Hudson . | |
| 4,025,186 | 5/1977 | Hunt et al. . | |
| 4,027,621 | 6/1977 | Kane et al. . | |
| 4,086,006 | 4/1978 | Hauser et al. . | |
| 4,265,197 | 5/1981 | Toyono et al. | 118/657 |
| 4,292,387 | 9/1981 | Kanbe et al. | 118/657 X |
| 4,292,921 | 10/1981 | Kroll et al. . | |
| 4,376,813 | 3/1983 | Yuge et al. | 430/122 X |

FOREIGN PATENT DOCUMENTS

| | | | |
|---|---|---|---|
| 972552 | 8/1975 | Canada . | |
| 55-133057 | 10/1980 | Japan | 430/122 |
| 57-177171 | 10/1982 | Japan | 118/657 |
| 57-177170 | 10/1982 | Japan | 118/657 |

*Primary Examiner*—Roland E. Martin

*Attorney, Agent, or Firm*—G. Herman Childress

[57] ABSTRACT

Apparatus and method for developing electrographically formed electrostatic images. Background development and "flaming" are minimized by applying composite D.C. and A.C. signals to a development electrode in a magnetic brush. The DC signal level is selected to minimize background development and the AC signal is chosen to minimize flaming.

4 Claims, 2 Drawing Figures

ELECTRIC FIELD ADJUSTMENT FOR MAGNETIC BRUSHES

BACKGROUND OF THE INVENTION

The present invention relates to magnetic brush apparatus in which a development electrode is biased with composite D.C. and A.C. signals to minimize background development and flaming.

Among triboelectric developing apparatus, the most commonly used are cascade apparatus and magnetic brush apparatus. In cascade apparatus, gravity is used to roll developer across the image. Cascade apparatus generally are used in low-speed copiers. A reason for this is that in a high-speed copier, a cascade apparatus would require substantial more space than magnetic brush apparatus to effectively tone electrostatic images.

In magnetic brush apparatus which use a developer having carrier and toner particles, the carrier particles are ferromagnetic. These ferromagnetic carrier particles are held to an applicator surface, for example, a nonmagnetic cylinder, in a bristle formation, by magnets located inside the cylinder. The bristles are brushed across a surface carrying an electrostatic image. Areas of the image exerting less attractive force on the toner than is exerted by the carrier are cleaned of toner as they are brushed. Magnetic brush apparatus also may use what is known in the art as a single component developer. Such a developer is disclosed in U.S. Pat. No. 3,816,840 issued June 11, 1974 to Kotz. In U.K. patent application No. 2,073,057, a magnetic brush apparatus for a single component developer is shown. The brush is biased with an A.C. signal which according to this patent improves the tonal rendition of a developed image.

To prevent attraction of toner to background portions of the electrostatic image, it is a common practice to electrically bias an electrode provided in the magnetic brush apparatus at a voltage level approximately equal to and at the same polarity as the voltage of the background portion of the images on the image-carrying member. The resultant electric field, which acts on toner particles and effects toning of an image, is related to the difference between the charge or voltage on the photoconductor and the bias voltage placed on the electrode.

Magnetic brush development often causes flaming. Flaming is the incomplete development of the leading edge of a large solid area. Flaming is related to the velocity of moving image-carrying member, the charge $V_o$ on the photoconductor and the bias voltage. As the velocity of the member increases, flaming increases. A discussion of flaming is set forth in commonly assigned U.S. Pat. No. 4,292,921 to Kroll et al. As is disclosed in the Kroll et al patent and also in Research Disclosure No. 16126 (September 1977), a counter-current roller preceeded by a co-current roller can reduce flaming. Research Disclosure is published by Kenneth Mason Publications, Ltd., the Old harbourmaster's, Eight North Street, Emsworth, Hampshire P010 7DD, ENGLAND. A difficulty with this approach is that even though may be reduced at low speeds, when development of an image on a high-speed member is needed, there may not be sufficient toner applied to an electrostatic image to fully develop large solid areas.

In order to enhance development of electrostatic latent images and increase development of large solid images moving at high speed, many magnetic brush development apparatus include four or more brushes. See, for example, U.S. Pat. No. 3,911,864 where the magnetic brushes rotate in alternate directions, and U.S. Pat. Nos. 4,027,621, and 4,086,006, where all magnetic brushes rotate co-current. Such magnetic brush apparatus are complex, require substantial space and are expensive to manufacture.

SUMMARY OF THE INVENTION

In view of the foregoing, an object of the invention is to minimize the "flaming" defect without resorting to increasing the number of magnetic brushes. The present invention involves the discovery that superimposing A.C. and D.C. electric signals and applying them to an electrode in a magnetic brush apparatus will minimize not only background development but also flaming. More particularly, the level of the D.C. signal is selected to minimize background development and the frequency of the A.C. signal is selected to minimize flaming.

A feature of the invention is that the peak-to-peak voltage of the A.C. signal can be selected to provide fully developed large solid areas. A possible mechanism which explains this phenomena is described later in the Description of the Preferred Embodiment.

DESCRIPTION OF THE PREFERRED EMBODIMENT

Figure 1:
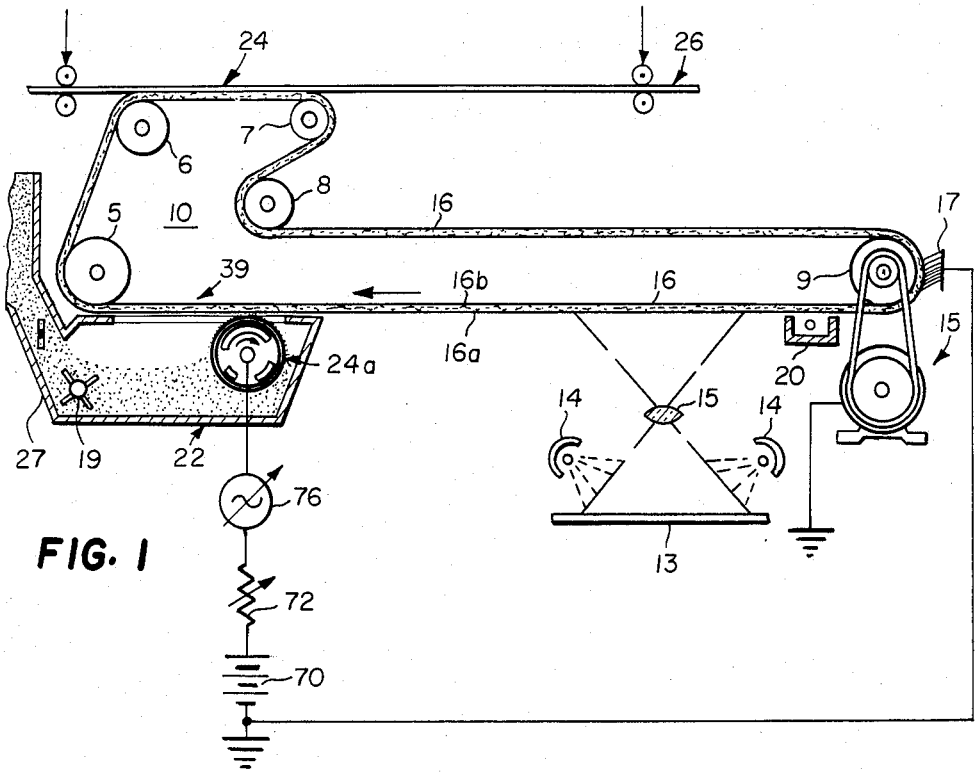
FIG. 1 is a schematic vertical section of a copier apparatus embodying the present invention.

For a general understanding of a web-type or copier apparatus 10 wherein the invention has utility, reference is made to FIG. 1. As shown, a photoconductor member, in the form of a web 16, is trained about rollers 5 through 9, with the roller 9 being driven by a drive mechanism 15 shown for simplicity to include a motor-pulley arrangement. The surface 16*a* of the web 16 is uniformly charged at a charging station 20. The web 16 is electrically connected to machine ground by a brush 17. The web 16 may for example include a photoconductive layer with a conductive backing on a polyester support. Thereafter, an information medium 13 such as a document is illuminated by radiation from flash lamps 14. Such radiation is reflected from the medium and projected by a lens 15 onto the charged insulating surface 16*a* of the web 16, to selectively dissipate charge and form an electrostatic image of medium 13 on the web.

The apparatus 10 further includes a magnetic brush apparatus 22 at which the moving electrostatic image is contacted with finely divided charged toner particles that adhere to the charged web surface in a configuration defined by the electrostatic image, to form a visible toner image; a transfer station 24 (not shown) in which the toner image is transferred to a receiving surface of a copy sheet 26 on which it can be subsequently permanently fused; and a cleaning station (not shown) in which residual toner particles are removed from the web 16. For a more complete description of the general organization of a similar copier apparatus, reference may be made to commonly assigned U.S. Pat. No. 4,025,186, issued May 24, 1977 to Hunt et al.

Figure 2:
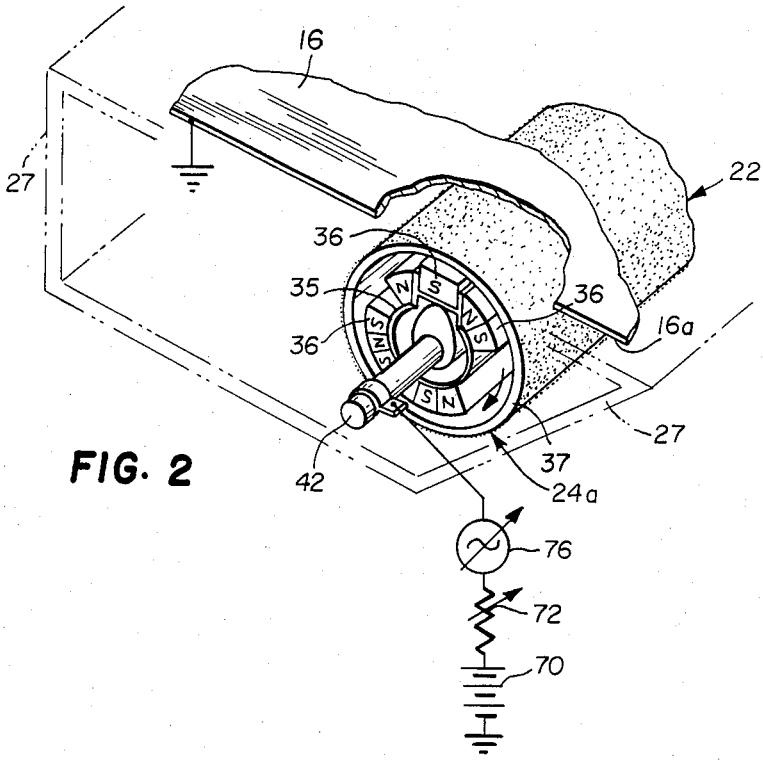
FIG. 2 is a pictorial perspective of the magnetic brush apparatus shown in FIG. 1

As best shown in FIG. 2, an electrostatic image (not shown) on the insulating surface 16*a* of web 16 is moved past a magnetic brush 24*a* mounted in a developer housing 27 which holds a supply of developer consisting of a mixture of toner and carrier particles. The carrier particles are made of a magnetic material such as iron. Simply stated, a magnetic material is one which a magnet attracts. The toner particles are finely divided and are held to the surface of much larger carrier particles by electrostatic charges created by triboelectrification, caused by a mixing paddle wheel 19 (see FIG. 1) and augers (not shown). For a specific example of such a developer, see commonly assigned U.S. Pat. No. 3,893,935, issued July 8, 1975 to Jadwin et al. The brush can be constructed according to any one of a variety of designs known in the prior art. A preferred configuration shown in FIG. 2 includes a stationary tubular magnetic pole piece 35 formed of soft steel or other magnetic material. Mounted around part of the circumference of the pole piece 35 are permanent magnets 36, formed for example of a rubber bonded barium ferrite strips. Concentric with these magnets 36 and on the outside thereof, is a rotatable, preferably grooved, hollow, non-magnetic, applicator cylinder 37. The cylinder 37 may be made of aluminum. As the cylinder 37 rotates, by means not shown, developer is held on its surface and moves with the roller while in the field of magnets 36.

The magnetic field from these internal magnets 36 attract the carrier particles and cause the developer to form on the cylinder a nap or coating which appears like a fine-bristled brush. The web is lightly pressed against these bristles, and the bristles supply toner particles to the electrostatic images.

When the developer is brought into contact with an electrostatic image, the charge on the image overcomes the attraction of the carrier for the toner and causes toner to transfer from the bristles to the image. In this process, toner is removed from the developer and carried away on the web 16 for later transfer to copy paper 26. For a more detailed description of a similar magnetic brush apparatus, reference may be made to commonly assigned U.S. Pat. No. 3,543,720 issued Dec. 1, 1970 in the names of Drexler et al.

The electrical resistance of the developer nap is inversely related to its conductivity. The resistivity of the developer affects the electric field caused by a bias voltage applied to a development electrode. A change in only the resistivity of the developer can effect background development, but it has been observed that it does not have any significant effect on the flaming problem. The shaft 42, the cylinder 37, and the housing 27 provide the electrode. The shaft 42 is electrically connected to the housing 27 (by means not shown). It will be understood to those skilled in the art, that the electrode could also be provided by a conductive metal plate disposed in the housing 27.

The shaft 42 is electrically connected to a source of D.C. potential shown as a battery 70 through an adjustable resistor 72, the resistance of which controls the applied D.C. voltage. An adjustable A.C. power supply 76 is electrically connected to the battery 70 and to the shaft 42. The frequency and peak-to-peak voltage of the applied A.C. signal can be adjusted.

The A.C. and D.C. signals are superimposed to form a composite signal that causes an electric field emanating from electrode to be applied between the applicator cylinder 37 and the web 16. The steady state or D.C. field is selected to minimize background development and the time varying or A.C. field is selected to minimize flaming. The peak-to-peak voltage of the A.C. signal is selected to provide solid area image which are fully developed. It has been found that the peak-to-peak voltage of the A.C. signal directly effects solid area image development. With any given A.C. frequency, there will be a range of peak-to-peak voltage which "fully develops" solid image of peak-to-peak areas. Peak-to-peak voltages above this range produce solid image areas which have image imperfections in the form of mottle, while with voltages below this range, flaming will still be a problem.

For illustrative purposes, let us assume background portions of images are being developed. As is well known in the art, to correct this deficiency, an operator will want to increase the D.C. voltage applied on the electrode. This is accomplished by reducing the resistance of adjustable resistor 72. If flaming is a problem, in accordance with this invention, the frequency of the A.C. power supply should now be varied until flaming is minimized. First, the frequency of power supply 76 is incrementally swept across a band of frequencies from D.C. to $4KH_z$. A copy is made at each increment. Let's say, for example, a copy is made at $400H_z$ increments: $400H_z$, $800H_z$, $1200H_z$ . . . $3600H_z$, $4000H_z$. Two frequencies at which the copies evidence minimum flaming are then selected. Copies are now made at frequencies between these two selected frequencies until the frequency which minimizes flaming is found. The peak-to-peak voltage is now adjusted and copies made to find a suitable level which fully develops solid image areas. Then the desired number of copies are made at the emperically established voltages and frequency.

A commercially available EKTAPRINT Copier/-Duplicator manufactured by the Eastman Kodak Company of Rochester, New York, was operated under usual conditions with the following process parameters. The photoconductor was moving at a constant velocity of about 28.58 cm/second; the voltage $V_o$ on the photoconductor after being charged was about $-600$ volts; and the resistance of resistor 72 adjusted until the electrode was D.C. biased at about $-175$ volts. This bias minimized background development. The frequency of the A.C. signal was adjusted until flaming was minimized. The A.C. signal frequency was 3 $KH_z$. The peak-to-peak voltage was adjusted until with a peak-to-peak voltage of 600 volts solid areas were fully developed.

The D.C. signal minimizes background development for the reasons set forth above. Why does the A.C. minimize flaming? The following is believed to be a plausible explanation of this phenomena.

When the charged leading edge of a solid area encounters the magnetic brush, the inertia of toner particles held to carrier particles is such that sufficient quantities of toner are not physically able to move into contact with the charged leading edge, thereby causing leading edge underdevelopment. When an A.C. signal is applied, it oscillates the developer at the interface between the nap and the photoconductor. Oscillating toner is more readily able to move into contact with the charged leading edge under the urging of electrostatic forces. With the EKTAPRINT copier, it was observed that when the frequency of the applied A.C. signal was below about 200 $H_z$, bands of light and dark areas were produced on copies. When the frequency was about 3 $KH_z$, flaming was eliminated. Above 3 $KH_z$ the copy image had noticable imperfections in the form of mottle.

The peak-to-peak voltage range which fully developed solid image areas was found to be between 130–800 volts.

The invention has been described with particular reference to a preferred embodiment thereof, but it will be understood that variations and modifications can be effected within the spirit and scope of the invention. For example, the developer has been described as a two component (toner and carrier) developer, but the invention may be practiced with a single component developer. For a specific example of such a single component developer, see commonly assigned U.S. Pat. No. 3,639,245, issued Feb. 1, 1972 to Nelson.

What is claimed is:

1. A method of reducing flaming and background development of an electrostatic image carried on a surface of a member comprising the steps of:

contacting the surface with a developer comprising a magnetic carrier and toner particles that have been triboelectrically charged, applying a steady state electrical bias between the developer material and the member with the steady state bias being selected to minimize background development on the member, applying an A.C. voltage signal between the developer material and the member, adjusting the frequency of the A.C. signal to minimize flaming of images developed on such member, and adjusting the peak-to-peak voltage of the A.C. signal until it is at a level which fully develops solid image areas on the member without mottle.

2. The invention as set forth in claim 1 wherein the frequency of the A.C. voltage signal is adjusted to a frequency less than about $4KH_z$.

3. In a magnetic brush apparatus for developing electrostatic images on a surface of an image-bearing member by using a developer comprising a mixture of toner and carrier particles that can be triboelectrically charged, said apparatus including a developer applicator having a mixture of toner and carrier particles thereon, magnetic field producing means for forming bristles of such developer on said applicator, means for maintaining contact between the surface of the image-bearing member and such bristles to develop electrostatic images, the improvement comprising: bias means for applying an electric field between the applicator and the image-bearing member, the bias means comprising a steady state component which is selected to minimize background development and a time-varying component having a frequency selected to minimize flaming, and said bias means including means for adjusting the peak-to-peak amplitude of the time-varying component to provide solid image areas that are fully developed and free of flaming but without mottle.

4. In a magnetic brush apparatus for applying toner to a member carrying an electrostatic image on a surface of the member by contacting the surface with a developer having a magnetic component and a toner component that can be triboelectrically charged, the improvement comprising:

(a) a hollow, non-magnetic, conductive, rotatable cylindrical applicator having a developer comprising a magnetic carrier component and a toner component thereon;

(b) magnetic means located inside said applicator for producing a magnetic field which acts upon said magnetic component and causes said developer to be carried by said applicator;

(c) means for pressing the surface of the member lightly against the developer on the applicator; and (d) bias control means for applying between said applicator and the member an electric field having a steady state component selected to minimize background development on said member and a time-varying component, the time varying component having a frequency and a peak-to-peak amplitude that can be adjusted, the frequency being adjusted to minimize flaming and the peak-to-peak amplitude being adjusted to fully develop solid area images without producing mottle.

* * * * *